US006923586B2

(12) United States Patent
Yoshihara

(10) Patent No.: US 6,923,586 B2
(45) Date of Patent: Aug. 2, 2005

(54) IMAGE FORMING APPARATUS

(75) Inventor: Hideo Yoshihara, Toki (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/869,856

(22) Filed: Jun. 18, 2004

(65) Prior Publication Data

US 2004/0234320 A1 Nov. 25, 2004

Related U.S. Application Data

(63) Continuation of application No. 10/379,684, filed on Mar. 6, 2003, now Pat. No. 6,767,149, which is a continuation of application No. 09/520,444, filed on Mar. 7, 2000, now Pat. No. 6,612,763.

(30) Foreign Application Priority Data

Mar. 31, 1999 (JP) ..... 11-90985

(51) Int. Cl.[7] ..... B41J 29/02

(52) U.S. Cl. ..... 400/692; 400/691; 399/111; 399/113

(58) Field of Search ..... 400/624, 690.4, 400/691–693; 399/75, 107–125

(56) References Cited

U.S. PATENT DOCUMENTS

| | | | | |
|---|---|---|---|---|
| 5,002,266 A | | 3/1991 | Kikuchi et al. | 271/3.2 |
| 5,099,341 A | | 3/1992 | Nosaki et al. | 358/461 |
| 5,418,606 A | | 5/1995 | Kikuchi et al. | 399/381 |
| 5,443,252 A | | 8/1995 | Morinaga et al. | 271/127 |
| 5,548,379 A | | 8/1996 | Fukuchi et al. | 399/116 |
| 5,579,098 A | | 11/1996 | Noguchi et al. | 399/122 |
| 5,606,406 A | | 2/1997 | Ikeyama et al. | 399/111 |
| 5,953,560 A | * | 9/1999 | Numagami et al. | 399/111 |
| 6,041,203 A | | 3/2000 | Suzuki et al. | 399/111 |
| 6,101,350 A | | 8/2000 | Suzuki et al. | 399/113 |
| 6,219,505 B1 | * | 4/2001 | Sato et al. | 399/98 |
| 6,330,410 B1 | | 12/2001 | Okabe et al. | 399/113 |
| 6,411,789 B1 | | 6/2002 | Okabe et al. | 399/113 |
| 6,546,217 B2 | * | 4/2003 | Okabe et al. | 399/113 |
| 2002/0141779 A1 | | 10/2002 | Okabe et al. | 399/113 |

FOREIGN PATENT DOCUMENTS

| | | |
|---|---|---|
| JP | B2 6-97354 | 11/1994 |
| JP | B2 7-40168 | 5/1995 |
| JP | 07-302032 A | 11/1995 |
| JP | 11-184197 | 7/1999 |
| JP | 11-198496 | 7/1999 |

* cited by examiner

*Primary Examiner*—Minh Chau
(74) *Attorney, Agent, or Firm*—Oliff & Berridge, PLC

(57) ABSTRACT

An image forming apparatus having a print unit; and a reading unit, mounted above the print unit, that reads an original image on a document. The print unit includes a housing accommodating the print unit and formed with a first opening and a second opening at a front face; a feed cassette that accommodates a recording medium, the first opening allowing attaching and detaching of the feed cassette through the front face; a process cartridge that forms an image on the recording medium, the second opening allowing attaching and detaching of the process cartridge through the front face; a discharge tray formed at an upper surface of the housing of the print unit, the recording medium being fed to the discharge tray from the process cartridge; a cover provided at the front face of the housing, the cover being positioned between an open position and a closed position, the second opening being revealed with the cover at the open position; and a slit integrally formed with the cover, wherein the recording medium from the feed cassette and the recording medium from the slit are guided to a common path and fed to the process cartridge.

14 Claims, 11 Drawing Sheets

IMAGE FORMING APPARATUS

This is a Continuation of application Ser. No. 10/379,684, filed Mar. 6, 2003 now U.S. Pat. No. 6,767,149, which in turn is a Continuation of application Ser. No. 09/520,444, filed Mar. 7, 2000 now U.S. Pat. No. 6,612,763. The entire disclosures of the prior applications are hereby incorporated by reference herein in their entirety.

BACKGROUND OF THE INVENTION

1. Field of the Invention

The present invention relates to an image forming apparatus mountable in a limited amount of space and, more particularly, to a laser beam printer mountable in a limited amount of space.

2. Description of the Related Art

Japanese Examined Patent Publications Nos. 6-97354 and 7-40168 disclose laser beam printers to which a process unit, accommodating a photosensitive drum, and a consumable article, such as toner, is detachably attached.

In a printer disclosed in the Japanese Patent Publication 6-97354, space must be provided above the printer to facilitate replacement of the process unit. Thus, the space above the printer cannot be freed for effective use.

In a printer disclosed in the Japanese Patent Publication 7-40168, an attaching/detaching direction of a paper feed cassette is perpendicular to a mounting direction of a process unit. Specifically, the paper feed cassette is pulled out to the front from the printer, while the process unit is pulled out to the right therefrom. Accordingly, space for attaching/detaching the paper feed cassette, as well as space for replacing the process unit, are required at the front and on the right side of the printer, respectively. As a result, a footprint of the printer, i.e., the required size of the surface on which the printer is disposed, is increased.

SUMMARY OF THE INVENTION

It is therefore an object of the invention to provide an image forming apparatus that has a small footprint, and thereby enables space around the printer to be freed for effective use.

To attain this object, in an image forming apparatus according to the invention, a paper feed cassette accommodating unit, an image forming unit, and a paper discharge unit are arranged vertically within a housing. Accordingly, the footprint of the image forming apparatus can be reduced.

Further, an opening for attaching/detaching a process unit and another opening for attaching/detaching a paper feed cassette are formed on the front face of the housing. Thus, it is unnecessary to open the upper surface of the housing. Since both the opening for attaching/detaching the process unit and the opening for attaching/detaching the paper feed cassette are provided on the front face of the housing, the same space that is used for attaching/detaching the paper feed cassette can be used for attaching/detaching the process unit. Accordingly, it is unnecessary to take the trouble to open the periphery of the image forming apparatus prior to attaching/detaching the process unit. As a result, the operations of attaching/detaching are facilitated, and the footprint of the image forming apparatus can be reduced.

It is preferable that the process unit is designed to be detachably attached to the housing in a direction perpendicular to an axial direction of a photosensitive drum that is accommodated in the process unit.

In this case, the attaching/detaching direction of the process unit and a paper discharge direction can be easily made to be the same. Further, the attaching/detaching direction of the paper feed cassette can be easily made to be the same (directed to the front). Accordingly, it is unnecessary to open sides of the apparatus other than the front side. As a result, the footprint can be reduced and space around the image forming apparatus can be freed for effective use.

A laser scanner may be disposed above the process unit within the housing.

In this case, the laser scanner will not interfere with the process unit when the process unit is attached/detached from the front side of the housing. Thus, it is unnecessary to move the laser scanner prior to attaching/detaching the process unit. Since the laser scanner can be moved upward without opening the upper portion of the housing, space above the housing can be freed for effective use.

Further, it is preferable that the upper surface of the housing is made to be planar. In this case, another device can be placed on the upper surface of the housing, and space for paper discharged by a paper discharge unit can be provided below the device. Thus, space above the housing can be effectively used.

The paper discharge unit may be accommodated within the housing, and an opening for removing paper discharged by the paper discharge unit may be provided in the housing. In this case, paper discharged by the paper discharge unit can be removed through the opening, while space above the housing is available for effective use.

Further, when a leading edge of paper discharged by the paper discharge unit is arranged to project outwardly from the front of the housing, discharged paper can be readily removed.

Further, the upper surface of the housing is made to be detachable. The upper portion of the paper discharge unit can then be opened when needed.

Still further, an operation panel accepting a user's operations and an insertion slot for allowing manual paper insertion may be provided on the front face of the housing.

BRIEF DESCRIPTION OF THE DRAWINGS

Preferred embodiments of the invention will be described in detail with reference to the following figures wherein.

DETAILED DESCRIPTION OF THE PREFERRED EMBODIMENTS

First Embodiment

Figure 1:
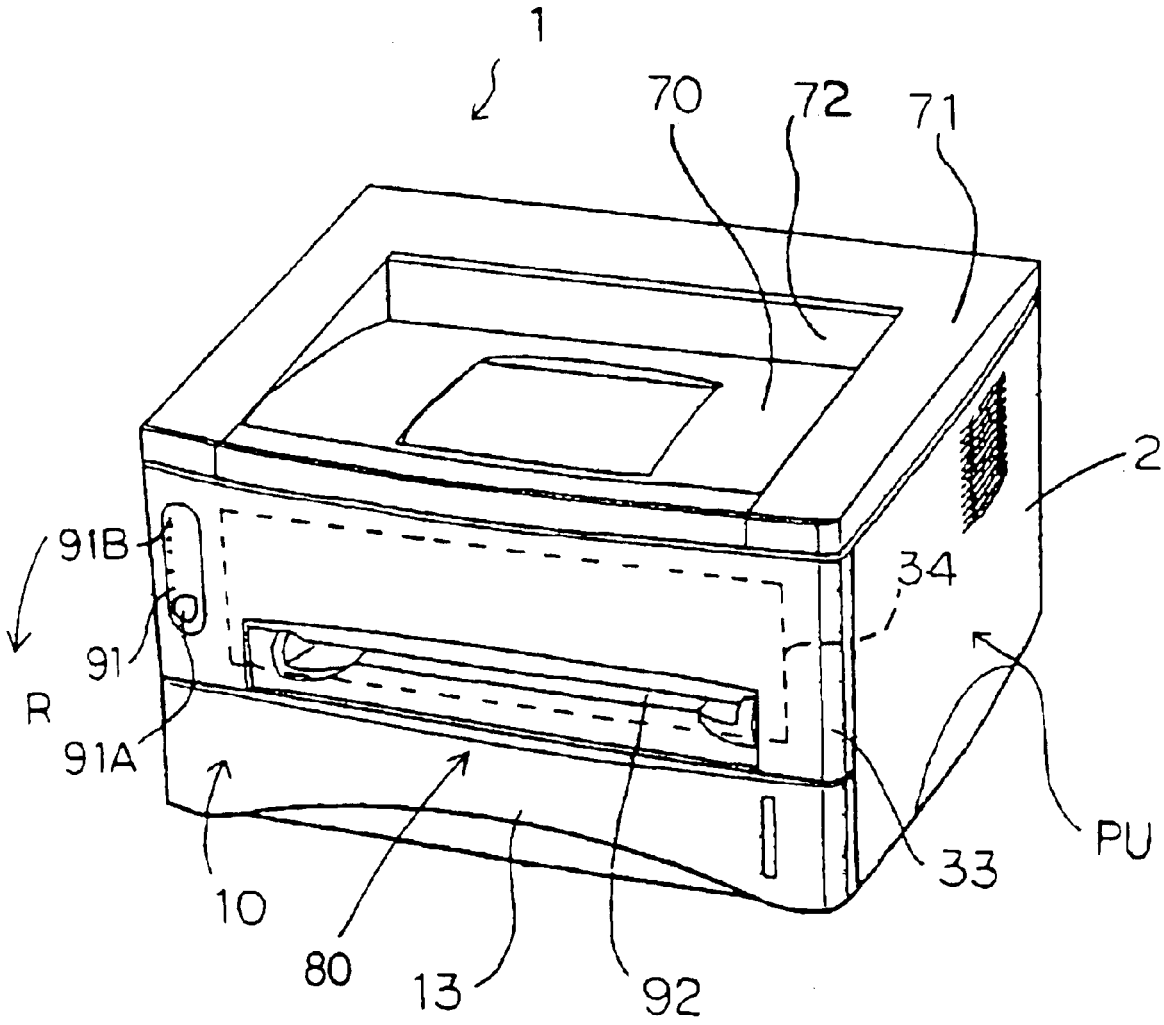
FIG. 1 is a perspective view showing a first embodiment of the invention.

An image forming apparatus according to a first embodiment of the invention as applied to a laser beam printer will be described with reference to FIGS. 1 to 5B. FIG. 1 is a perspective view showing the laser beam printer, and FIG. 2 is a vertical sectional view of the laser beam printer.

Figure 2:
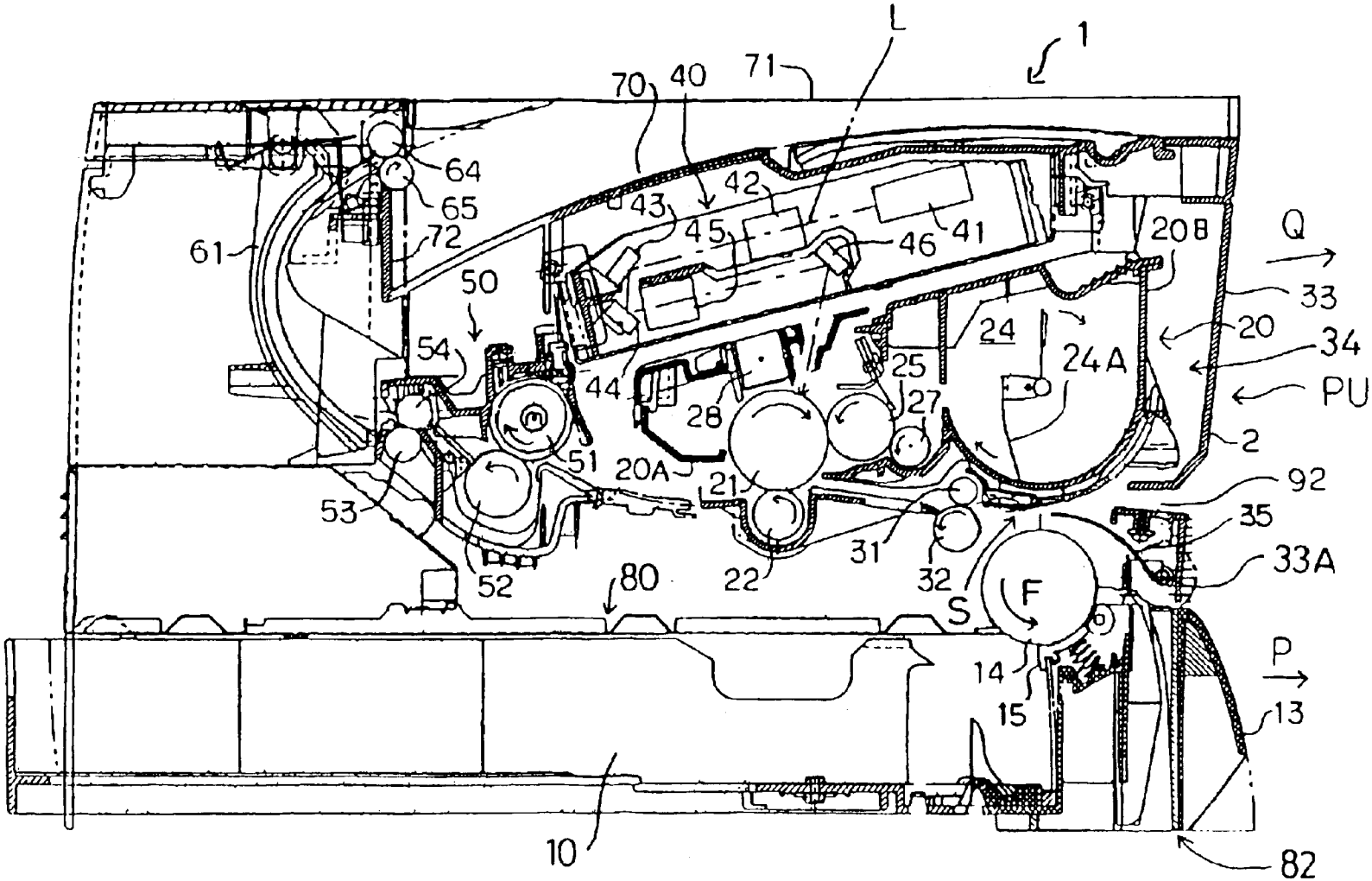
FIG. 2 is a vertical sectional view of the first embodiment.
Figure 3:
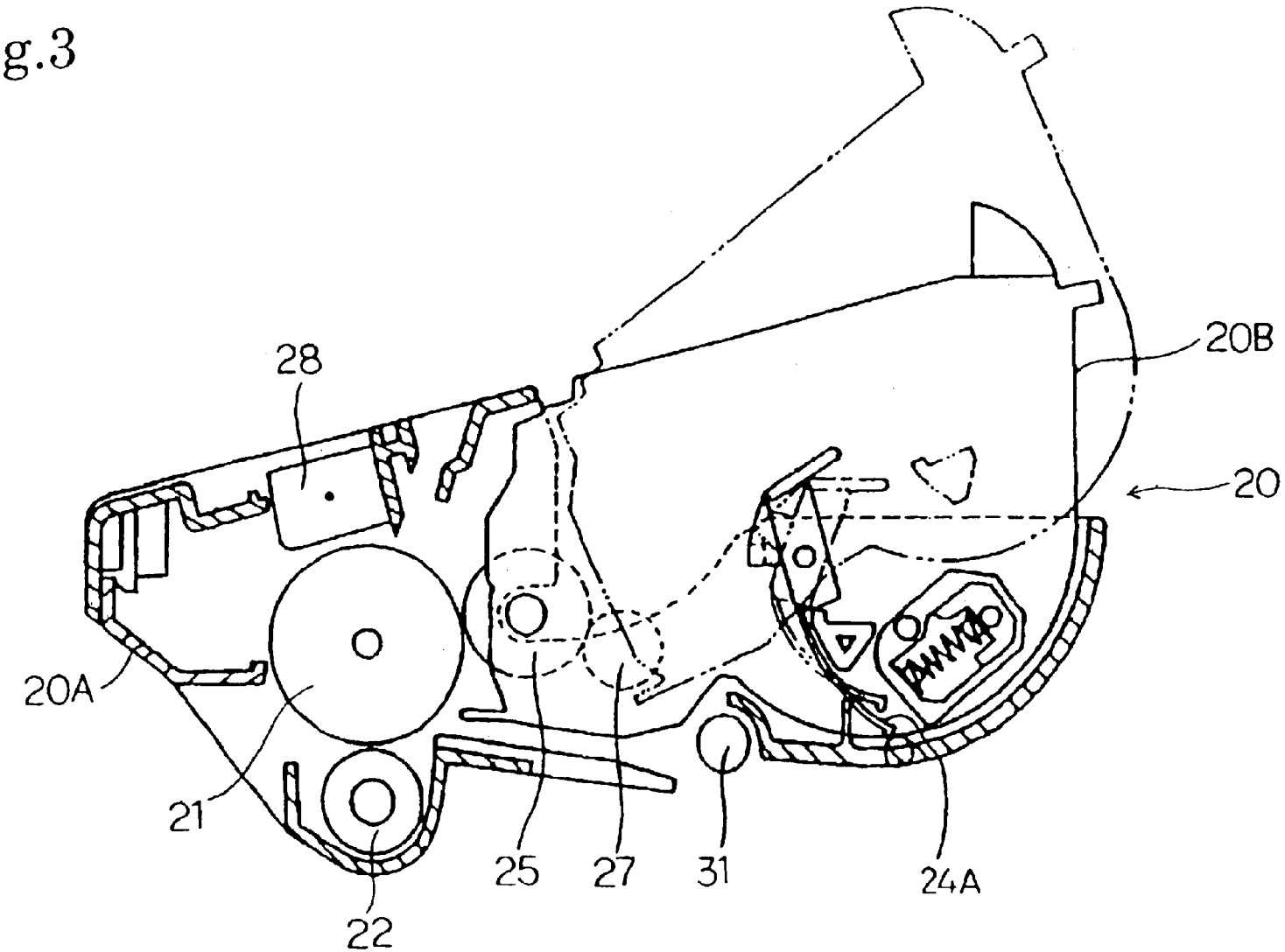
FIG. 3 is a sectional view showing a process cartridge.

As shown in FIGS. 1 and 2, the laser beam printer 1 is provided with a print unit PU having a housing 2. Mounted below the print unit PU, which is a substantially rectangular parallelepiped, is a paper feed cassette 10 with a handle 13. The paper feed cassette 10 accommodates a stack of paper and is detachably attached to a cassette mount 80 provided for the housing. The cassette mount 80 has an opening 82 provided on the front face of the housing 2 to allow attaching/detaching of the paper feed cassette 10. A user can remove the paper feed cassette 10 from the printer 1 by holding the handle 13 and pulling the paper feed cassette 10 toward the front (in the direction of arrow P of FIG. 2).

In the paper feed cassette 10, a paper lifter plate (not shown) upwardly urged by a pressure spring (not shown) is provided. The uppermost sheet of paper stacked on the paper lifter plate makes contact with a paper feed roller 14 that rotates in the direction of arrow F shown in FIG. 2. The uppermost sheet is separately fed with aid of a separation pad 15.

Provided on the front face of the printer 1 are an operation panel 91 having an operation button 91A and an LED (light-emitted diode) 91B, and an insertion slit 92 into which paper other than that accommodated in the paper feed cassette 10 (for example, OHP films) is inserted.

The opening 82, the operation panel 91, and the insertion slit 92 are all provided on the front face of the housing 2, which allows the user to operate all of them readily from the same side.

As shown in FIG. 2, a process cartridge 20 is disposed above the paper feed cassette 10. The process cartridge 20 includes a photosensitive member cartridge 20A and a developer cartridge 20B. The photosensitive member cartridge 20A accommodates a photosensitive drum 21 that makes contact with the paper to transfer toner thereon, a transfer roller 22 opposed to the photosensitive drum 21, and a scorotron type charger 28 that generates corona discharge to positively charge the surface of the photosensitive drum 21.

The developer cartridge 20B accommodates a toner-containing developing chamber 24, a developing roller 25 that supplies toner to the photosensitive drum 21, and a supply roller that supplies toner to the developing roller 25. The developing chamber 24 is provided with an agitator 24A for agitating toner.

The photosensitive member cartridge 20A and the developer cartridge 20B can be separated from each other. The detailed structure of the photosensitive member cartridge 20A and the developer cartridge 20B is described in U.S. patent applications Ser. Nos. 09/281,947 and 09/281,948, which are herein incorporated by reference.

The process cartridge 20 is detachably attached to the housing 2 with the photosensitive member cartridge 20A and the developer cartridge 20B assembled. When the process cartridge 20 is detached from the printer 1, the photosensitive member cartridge 20A and the developer cartridge 20B are pulled out in their assembled condition.

A cover 33 is provided on the front face of the printer 1. The cover 33 is pivotally attached at its lower end to a pivot shaft 33A. The above-described insertion slit 92 is formed integrally with the cover 33. An opening 34 for attaching/detaching the process cartridge 20 is revealed by pivoting the cover 33 clockwise in FIG. 2 (in the direction of arrow R in FIG. 1). The user can pull out the process cartridge 20 in the direction of arrow Q through the opening 34 and attach a new process cartridge 20 therethrough.

As shown in FIG. 2, paper supplied from the paper feed cassette 10 and paper inserted from the insertion slit 92 are guided to a common paper feed path S. A pair of resist rollers 31, 32 is rotatably mounted between the process cartridge 20 and the paper feed cassette 10.

The photosensitive drum 21 is accommodated in the photosensitive member cartridge 20A such that the axial direction of the photosensitive drum 21 is perpendicular to the mounting direction of the process cartridge 20 to the housing 2. This makes the paper feed direction to be the same as the mounting direction of the process cartridge 20. In other words, the paper feed cassette 10 and the process cartridge 20 can be mounted from the same side, that is, the front side. Accordingly, operability of the printer 1 is improved and valuable space around the printer 1 is available for effective use.

Mounted above the process cartridge 20 is a laser scanner unit 40 that is provided with a laser generator (not shown) that emits a laser beam, a polygon mirror 41 that is driven to rotate, a lens 42, a reflection mirror 43, a reflection mirror 44, a lens 45, and a reflection mirror 46. As shown in FIG. 2, a laser beam L reflected by the polygon mirror 41 irradiates to the photosensitive drum 21, through the lens 42, the reflection mirrors 43, 44, and the lens 45, to form an electrostatic image on the surface of the photosensitive drum 21.

The laser scanner unit 40 provided above the process cartridge 20 will not interfere with the process cartridge 20 when it is replaced. Accordingly, the laser scanner unit 40 does not need to be moved prior to replacement of the process cartridge 20, and thus displacement of an optical axis can be prevented.

A fixing unit 50 for fixing toner onto the paper is provided on the left side of the process cartridge 20. The fixing unit 50 is provided with a heat roller 51 that heats and melts the toner transferred onto the paper, a pressure roller 52 that presses the supplied paper against the heat roller 51, and a pair of transport rollers 53, 54.

A curved chute 61 is pivotally attached on the left of the feed rollers 53, 54, as shown in FIG. 2, to reverse the paper feed direction. In an extending direction of the chute 61, a pair of discharge rollers 64, 65 is attached to support the paper transported along the chute 61 and discharge it to a paper discharge tray 70 formed on the upper surface of the print unit PU.

On either side of the paper discharge tray 70 (on the right and left sides and at the back in FIG. 1, and at the front and back in FIG. 2), a protrusion 71 with a planar upper surface is provided and, as shown in FIG. 2, the paper discharge tray 70 is stepped down from the upper surface of the protrusion 71.

Figure 4:
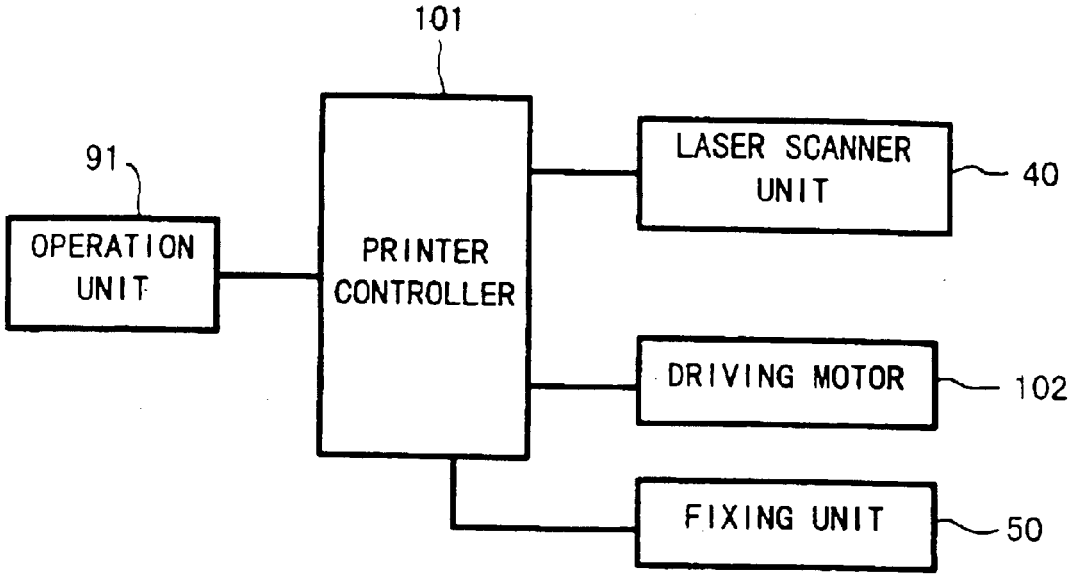
FIG. 4 is a block diagram showing a control system of the first embodiment.

FIG. 4 is a block diagram showing a control system of the laser beam printer. As shown in FIG. 4, the operation panel 91, the laser scanner unit 40, the fixing unit 50, and a motor 102 for driving the photosensitive drum 21 and the various rollers are all connected to a printer controller 101. The printer controller 101 controls operations of each part of the laser beam printer 1.

The paper feed operation will now be described.

When the paper feed roller 14 is rotated in a predetermined timed sequence, paper is fed from the paper feed cassette 10 sheet by sheet. The paper is reversed in its feeding direction and guided to the paper feed path S with aid of a guide 35. Upon the arrival of the leading edge of the paper at the resist rollers 31, 32, the position of the leading edge is adjusted, and then the paper is transported between the photosensitive drum 21 and the transfer roller 22.

On the other hand, the surface of the photosensitive drum 21 charged by the charger 28 is irradiated with a laser beam emitted from the laser scanner unit 40 and an electrostatic latent image is formed thereon. When the electrostatic latent image on the photosensitive drum 21 is opposed to the developing roller 25, toner carried by the supply roller 27 and the developing roller 25 turns the electrostatic latent image into a toner image. The toner image on the photosensitive drum 21 is transferred onto the paper passing between the photosensitive drum 21 and the transfer roller 22.

Then, the paper with the transferred toner image thereon passes between the heat roller 51 and the pressure roller 52. At this time, heat and pressure are applied to the toner image on the paper and the toner image is fixed onto the paper.

Further, the paper having passed between the transport rollers 53, 54 is transported along the chute 61 and discharged while sandwiched by the discharge rollers 64, 65 to the paper discharge tray 70 with its printed surface facing down.

Figure 5A:
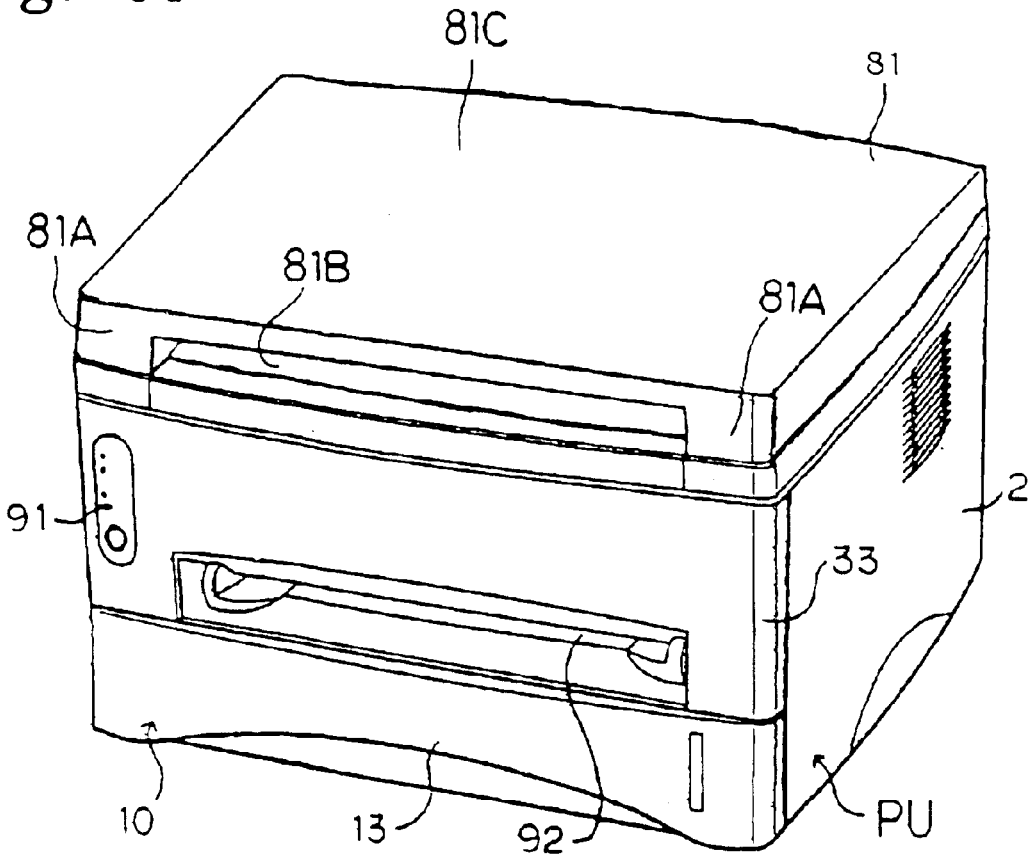
FIGS. 5A and 5B illustrate a cover, FIG. 5A being a perspective view of a printer, and FIG. 5B being a sectional view of the cover sectioned perpendicular to a front to rear direction of the printer.

As shown in FIG. 5A, a cover 81 can be placed on the upper surface of the protrusion 71. At this time, the paper discharge tray 70 is covered by the cover 81.

Figure 5B:
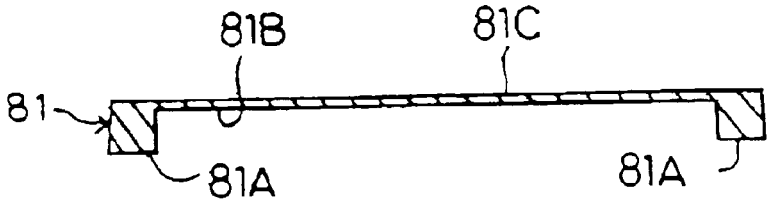

As shown in FIGS. 5A and 5B, the cover 81 is provided with legs 81A projecting downward. The lower end surfaces of the legs 81A are made flat. The cover 81 is placed on the upper portion of the housing 2 such that the lower end surfaces of the cover 81 are brought into contact with the upper surface of the protrusion 71. A cutaway 81B is formed in the cover 81, as shown in FIG. 5B. The cover 81 is placed on the upper surface of the protrusion 71 such that the cutaway 81B is positioned on the front face of the housing 2. Thus, the user can access the paper discharge tray 70 to remove the paper stacked thereon through the cutaway 81B.

As shown in FIGS. 5A and 5B, the upper surface 81C of the cover that encloses the paper discharge tray 70 is made flat, allowing other peripheral devices to be mounted on the cover 81. Accordingly, space above the printer 1 can be effectively used.

Since the paper stacked on the paper discharge tray 70 can be removed through the cutaway 81B, a peripheral device, if mounted on the cover 81, will not interfere with the paper removal. A peripheral device mounted on the cover 81 may be electrically connected to the printer 1 so that image data can be exchanged therebetween. Peripheral devices to be mounted on the cover 81 include a communication device for facsimile transmission and an image scanner for reading images.

To facilitate the removal of paper from the paper discharge tray, it is possible to project one edge of the discharged paper from the cover 81. Specifically, a distance from the stopper 72 (FIG. 2), against which the other edge of the discharged paper abuts, to the cutaway 81B should be adjusted to be shorter than the length of the paper (for example, A4- or B5-size paper) by a predetermined length. The distance may be adjusted according to the size of paper most frequently used in the printer 1 or according to the minimum size of paper usable in the printer 1. With this arrangement, one edge of the paper projects from the cutaway 81B, allowing the user to remove the paper easily by holding its one edge.

When the cover 81 is mounted on the printer 1, a vertical distance between the paper discharge tray 70 and the cover 81, that is, a vertical distance of an opening formed by the cutaway 81B, restricts the number of sheets stackable on the paper discharge tray 70. Thus, the cover 81 should be designed by considering the number of sheets discharged at a time. For example, it is preferable that the paper discharge tray 70 can stack the maximum number of sheets accommodated in the paper feed cassette 10.

In the above-described laser beam printer 1 according to the first embodiment of the invention, attaching/detaching the paper feed cassette 10, attaching/detaching the process cartridge 20, manual paper feeding, removal of discharged paper, and operation of the operation panel 91 can be all performed on the front side of the printer 1. Accordingly, all these operations and jobs can be performed by leaving space available only on the front side of the printer 1. Since it is unnecessary to open the lateral and upper sides of the printer 1 and unnecessarily to move the printer 1, the printer 1 is easily operable by the user. Further, the footprint of the printer 1 can be minimized and a limited amount of space can be made available for effective use.

Second Embodiment

Figure 6:
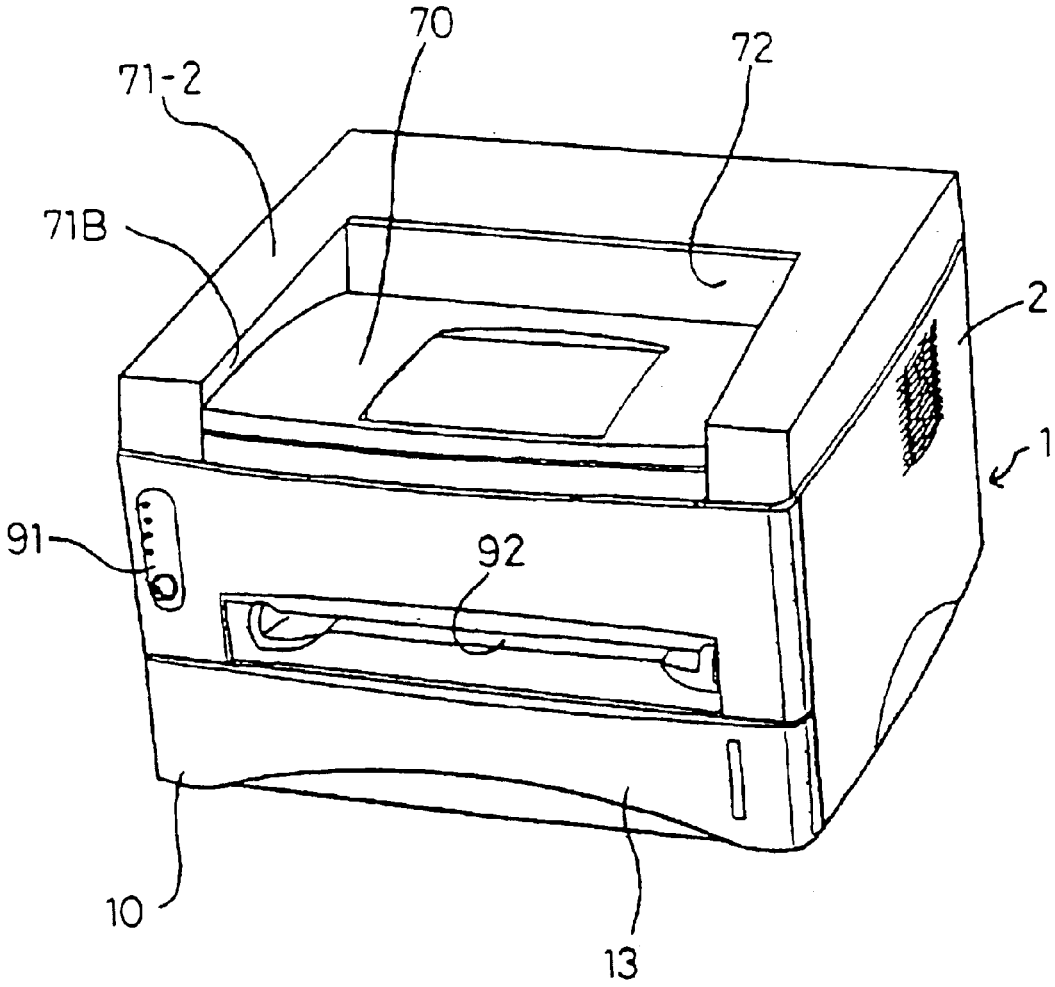
FIG. 6 is a perspective view showing a second embodiment of the invention.

A second embodiment of the invention will be described with reference to FIGS. 6 and 7.

The second embodiment is almost the same as the first embodiment except for a certain difference. As shown in FIG. 6, a protrusion 71-2 in the second embodiment projects to a higher position than the protrusion 71 in the first embodiment. A cutaway 71B is formed in the protrusion 71-2 that allows the paper discharge tray 70 to extend to the front face of the printer 1.

Figure 7A:
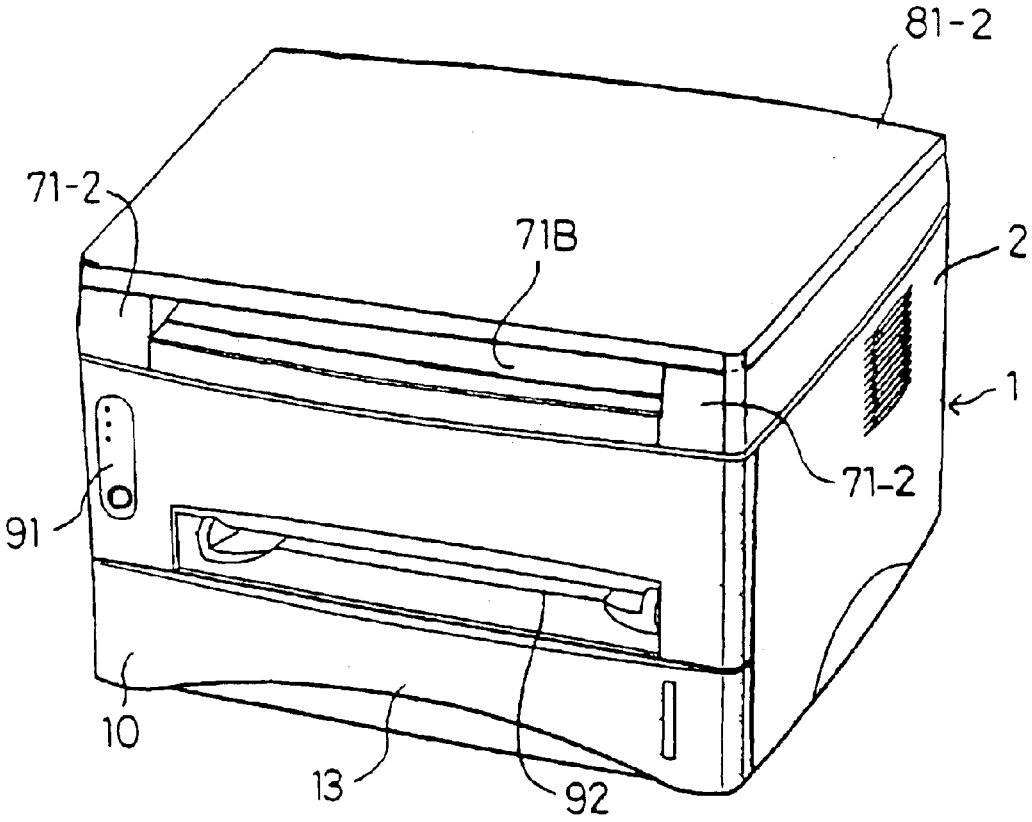
FIGS. 7A and 7B illustrate a cover, FIG. 7A being a perspective view of a printer, and FIG. 7B being a sectional view of the cover sectioned perpendicular to a front to rear direction of the printer.
Figure 7B:
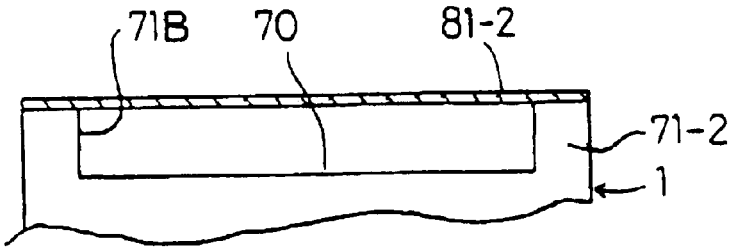

In the second embodiment, as shown in FIGS. 7A and 7B, a planar cover 81-2 can be mounted on the protrusion 71-2. The protrusion 71-2 is provided instead of the legs 81A of the cover 81 in the first embodiment. As shown in FIG. 7A, because the user can remove the discharged paper from the paper discharge tray 70 through the cutaway 71B, space on the upper side of the cover 81-2, that is, space above the printer 1, can be used freely. For example, various peripheral devices can be mounted on the upper surface of the cover 81-2.

At the same time, as the protrusion 71-2 provides space for stocking the discharged paper, any one of various peripheral devices can be mounted directly on the protrusion 71-2 without the cover 81-2 interposed therebetween. In such an arrangement, paper discharged on the tray 70 can be removed from the front side of the printer 1 through a clearance (cutaway 71B) between the tray 70 and a peripheral device mounted thereon. Even directly mounting a peripheral device having a flat bottom surface on the protrusion 71-2 provides space for stacking discharged paper and for allowing access to the discharged paper, without causing any inconveniences.

Accordingly, space above the printer 1 can be effectively used when the cover 81-2 is not interposed.

Also, in the second embodiment, it is possible to project one edge of the paper from the cover 81-2 by adjusting the distance from the stopper, against which the other edge of the paper abuts, to the cutaway 71B to be shorter than the length of the paper (for example, A4- or B5-size paper) by a predetermined length. Thus, the user can remove the paper easily by grasping the projecting one edge of the paper.

When the cover 81-2 or a peripheral device is mounted on the protrusion 71-2, the number of stackable sheets is restricted by the vertical space provided above the paper discharge tray 70. Accordingly, the height of the protrusion 71-2 should be designed by considering the number of stackable sheets. Specifically, it is preferable that the number of sheets accommodated in the paper feed cassette 10 can be stacked on the paper discharge tray 70.

Alternatively, if the paper discharge tray 70 is spaced 1 cm or more from the upper end surface of the protrusion 71-2, at least 50 or more sheets can be stacked. With this arrangement, the paper discharge tray 70 becomes more practical and unlikely to be filled with paper discharged by a single print output.

Third Embodiment

A third embodiment of the invention will now be described with reference to FIGS. 8 and 9. The third embodiment shows an exemplary case where a scanner unit for reading images is mounted above the printer 1 of FIG. 1.

Figure 8:
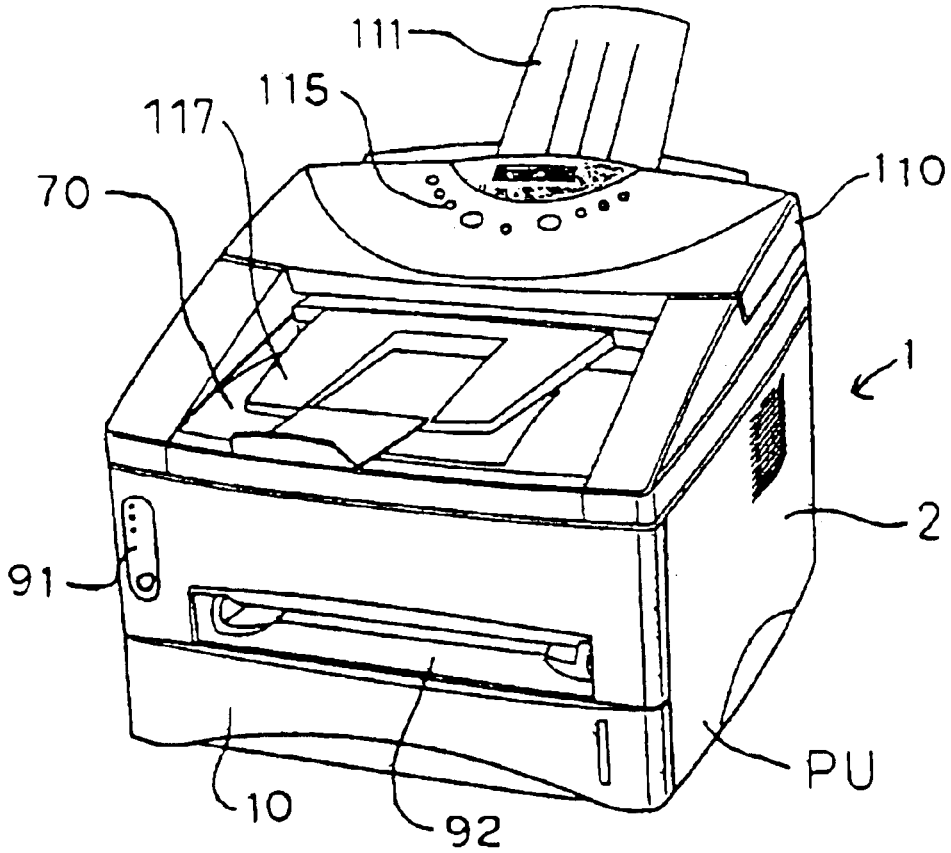
FIG. 8 is a perspective view showing a third embodiment of the invention.

As shown in FIG. 8, the printer 1 is provided with a print unit PU, that is common to the first embodiment, and a scanner unit 110 mounted above the printer unit PU for reading images. The print unit PU and the scanner unit 110 are accommodated in the single housing The scanner unit 110 is mounted above the print unit PU. The scanner unit 110 is provided with a document tray 111 that holds documents to be fed into the scanner unit 110, an image reader 112 (FIG. 9) that scans and reads images on the fed documents and converts the read images into electrical signals, and an operation panel 115 that receives operations as reading commands. Documents having passed the image reader 112 are discharged to a document discharge tray 117.

The document tray 111, the operation panel 115, and the document discharge tray 117 are provided so that the user can operate all of them from the front side of the printer 1. Paper on which printing has been performed by the print unit PU is discharged to the paper discharge tray 70 disposed below the document discharge tray 117.

Figure 9:
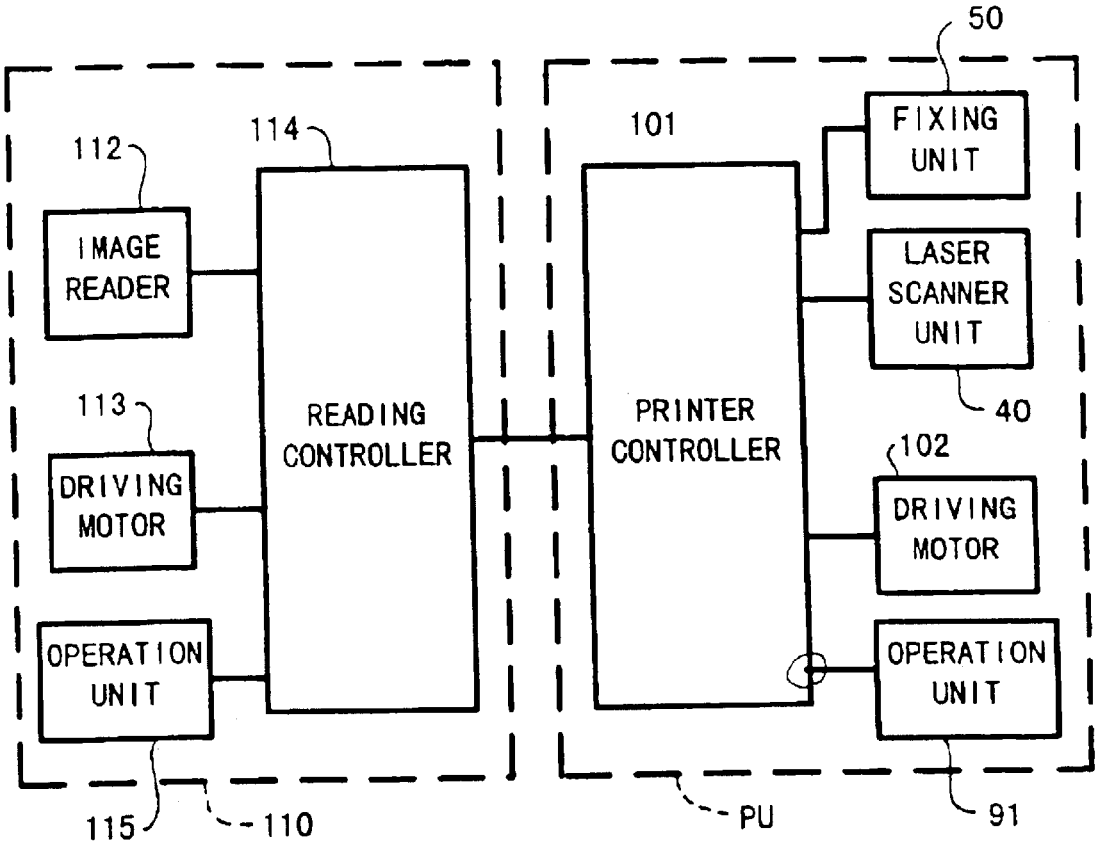
FIG. 9 is a block diagram showing a control system of the third embodiment.

FIG. 9 is a block diagram showing a control system of the third embodiment. As shown in FIG. 9, in the scanner unit 110, a driving motor 113 that drives a predetermined paper feed mechanism to feed paper, the image reader 112, and the operation panel 115 are connected to a reading controller 114. The reading controller 114 is also connected to a printer controller 101 of the print unit PU, which is the same as the printer controller 101 shown in FIG. 4.

The reading controller 114 and the printer controller 101 are arranged so as to communicate with each other, and thereby images read by the scanner unit 110 can be printed by the print unit PU. A predetermined interface or a connecting terminal may be provided so that a personal computer can process images read by the scanner unit 110.

In this way, since any operation of both the print unit PU and the scanner unit 110 can be performed from the front side of the printer 1, the printer 1 provides excellent operability to the user.

Fourth Embodiment

A fourth embodiment of the invention will now be described with reference to FIGS. 10A, 10B and 11. The fourth embodiment shows an exemplary case where a reading/communication unit 130 is mounted above the print unit PU of FIG. 1.

Figure 10A:
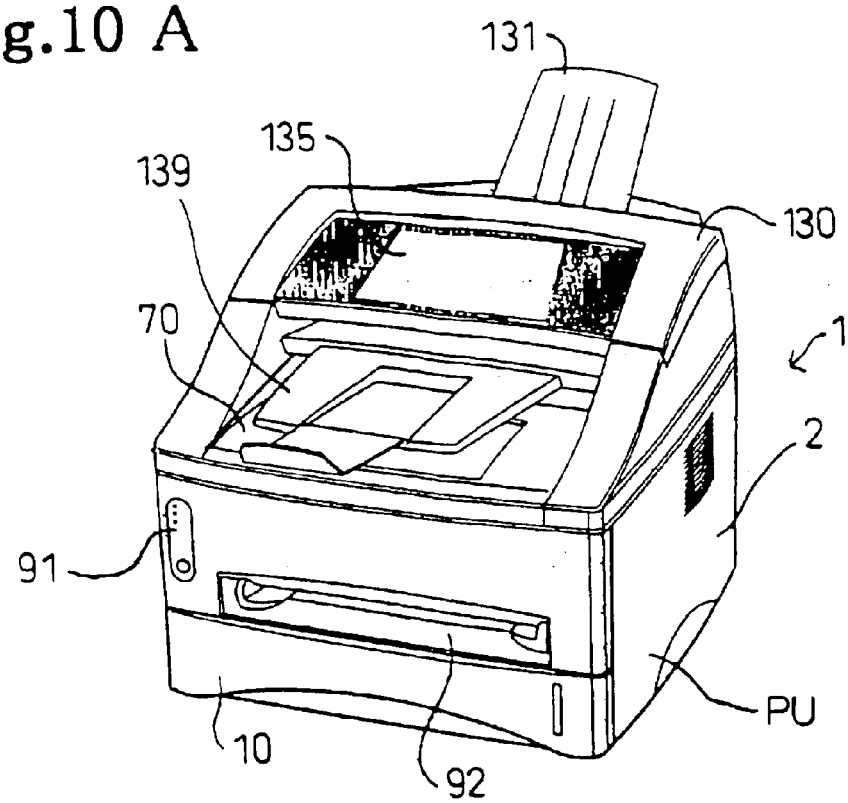
FIGS. 10A and 10B show a fourth embodiment of the invention, FIG. 10A being a perspective view showing the fourth embodiment, and FIG. 10B being a perspective view showing a printer having an additional telephone function.

As shown in FIG. 10A, the printer 1 is provided with a print unit PU that is common to the first embodiment and a reading/communication unit 130 mounted above the print unit PU. The print unit PU and the reading/communication unit 130 are accommodated in the single housing 2.

The reading/communication unit 130 has an image reading function and an image transmission/reception (facsimile) function. The reading/communication unit 130 is provided with an operation panel 135 having a touch panel on the screen of a liquid crystal display. Image reading, transmission and the like can be commanded through operation of the operation panel 135. Further, an image reader 112A is built in the reading/communication unit 130 to read images on documents sent from a document tray 131. The documents read by the image reader 112A are discharged to a document discharge tray 139. The document tray 131, the operation panel 135, and the document discharge tray 139 are all provided so as to be operable from the front side of the printer 1. Paper on which printing is performed by the print unit PU is discharged to a paper discharge tray 70 disposed below the document discharge tray 139.

Figure 11:
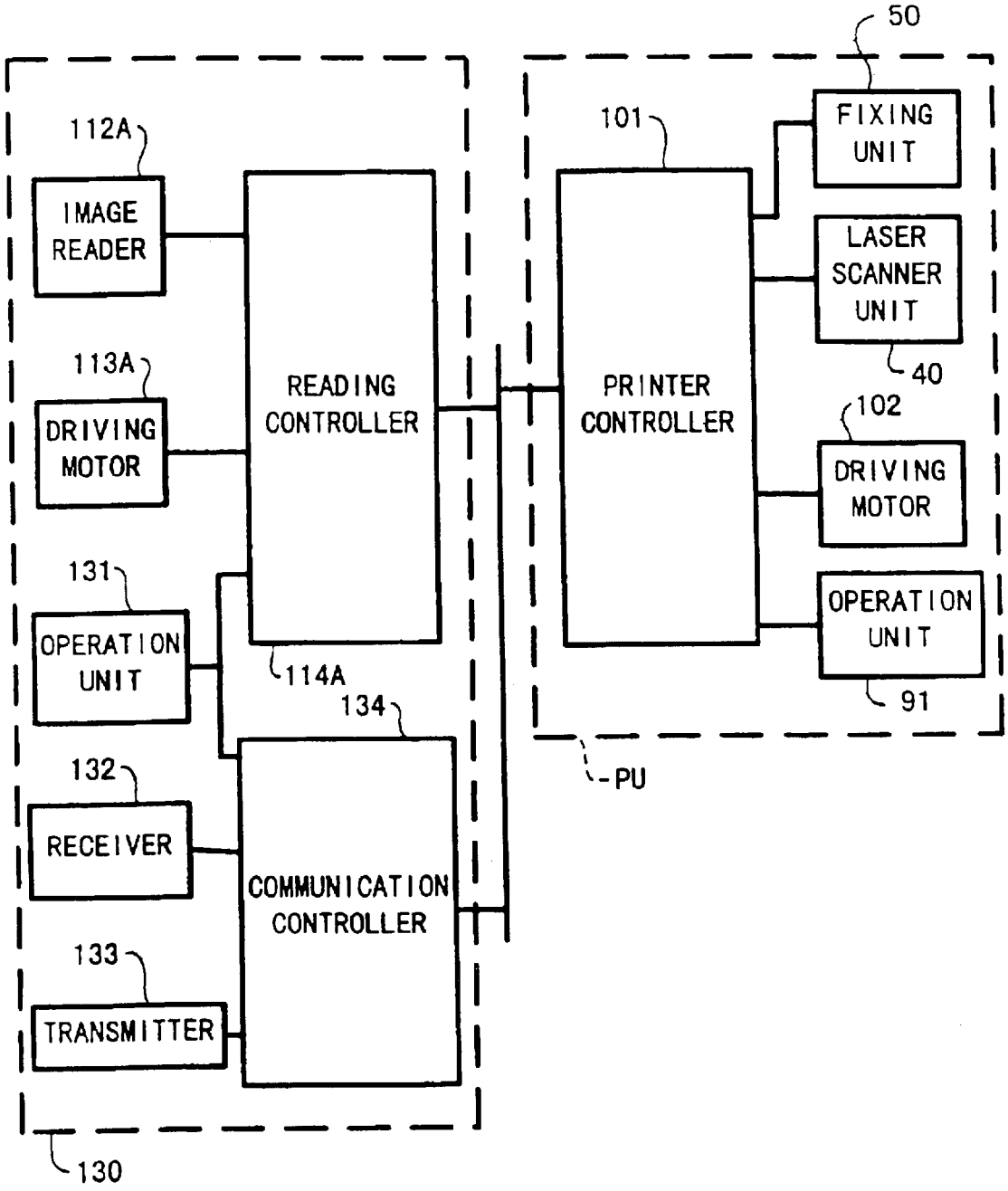
FIG. 11 is a block diagram showing a control system of the fourth embodiment.

FIG. 11 is a block diagram showing a control system of the fourth embodiment. The reading/communication unit 130 has a driving motor 113A that drives a predetermined paper feed mechanism to feed documents, an image reader 112A that reads images on the documents fed by the paper feed mechanism, and a reading controller 114A to which the operation panel 135, the driving motor 113A, and the image reader 112A are connected. The reading/communication unit 130 is further provided with a receiver 132 that receives data sent via public communication lines, a transmitter 133 that transmits data via public communications lines, a communication controller 134 to which the operation panel 135, the receiver 132, and the transmitter 133 are connected.

Since the reading controller 114A, the printer controller 101, and the communication controller 134 can communicate with each other, the print unit PU can print images read by the image reader 112A, or read images can be faxed via the transmitter 133. Further, a predetermined interface and a connecting terminal may be provided so that a personal computer can process images read by the image reader 112A or images received via the receiver 132.

In this way, since any operation of both the print unit PU and the reading/communication unit 130 can be performed from the front side of the printer 1, the printer 1 provides excellent operability to the user.

Figure 10B:
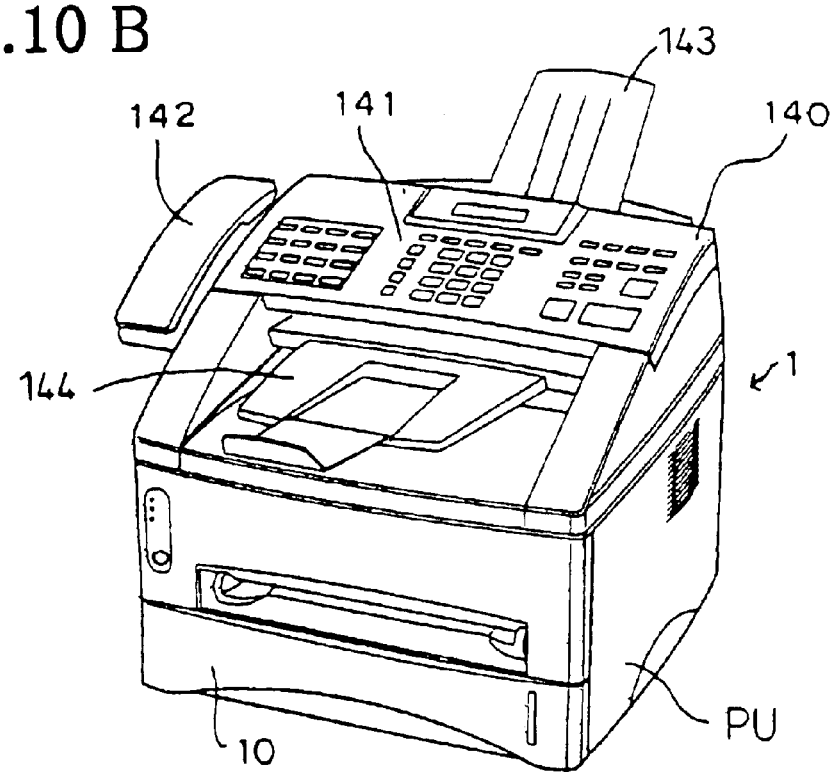

A printer 1 shown in FIG. 10B is provided with an additional telephone function as compared to the printer 1 of FIG. 10A.

In this printer 1, a reading/communication unit 140 is provided above the printer unit PU. The reading/communication unit 140 has an image reading function, an operation panel 141 accepting operational commands for facsimile/telephone functions, and a handset allowing telephone conversation via telephone lines. A document tray 143 and a document discharge tray 144 are also provided so at to be operable from the front side of the printer 1. Since any operation can be performed from the front side of the printer 1, the printer 1 provides excellent operability to the user.

What is claimed is:

1. An image forming apparatus, comprising:

a print unit; and a reading unit, mounted above the print unit, that reads an original image on a document, wherein the print unit comprises:

a housing accommodating the print unit and formed with a first opening and a second opening at a front face;

a feed cassette that accommodates a recording medium, the first opening allowing attaching and detaching of the feed cassette through the front face;

a process cartridge that forms an image on the recording medium, the second opening allowing attaching and detaching of the process cartridge through the front face;

a discharge tray formed at an upper surface of the housing of the print unit, the recording medium being fed to the discharge tray from the process cartridge;

a cover provided at the front face of the housing, the cover being positioned between an open position and a closed position, the second opening being revealed with the cover at the open position; and a slit integrally formed with the cover, wherein the recording medium from the feed cassette and the recording medium from the slit are guided to a common path and fed to the process cartridge.

2. The image forming apparatus according to claim 1, wherein the reading unit further comprises:

an image reader that reads the original image on the document;

a document tray from which the document is sent to the image reader; and a document discharge tray to which the document is discharged from the image reader.

3. The image forming apparatus according to claim 2, further comprises a discharge unit, provided at the upper portion of the housing of the print unit, that discharges the recording medium to the discharge tray fed from the process cartridge, wherein the reading unit is mounted above the discharge unit.

4. The image forming apparatus according to claim 3, wherein the discharge tray is positioned below the document discharge tray.

5. The image forming apparatus according to claim 2, wherein the discharge tray is positioned below the document discharge tray.

6. The image forming apparatus according to claim 2, wherein the reading unit further comprises:

a transmitter that transmits data of the original image read by the reading unit via a public communication line;

a receiver that receives data sent via the public communication line; and an operation panel through which the image reader and the transmitter are commanded.

7. The image forming apparatus according to claim 6, wherein the reading unit further comprises:

a telephone unit having a telephone function; and a handset allowing telephone conversations via a telephone line.

8. An image forming apparatus, comprising:

a housing formed with a first opening and a second opening at a front face;

a feed cassette that accommodates a recording medium, the first opening allowing attaching and detaching of the feed cassette through the front face;

a process cartridge that forms an image on the recording medium, the second opening allowing attaching and detaching of the process cartridge;

a discharge tray formed at an upper surface of the housing, the recording medium being fed to the discharge tray from the process cartridge;

a cover provided at the front face of the housing, the cover being positioned between an open position and a closed position, the second opening being revealed with the cover at the open position; and a slit integrally formed with the cover, wherein the recording medium from the feed cassette and the recording medium from the slit are guided to a common path and fed to the process cartridge.

9. The image forming apparatus according to claim 8, wherein a planar portion is provided at an upper portion of the housing.

10. The image forming apparatus according to claim 9, further comprising a peripheral device provided on the planar portion, the peripheral device being operable from a front side of the housing.

11. The image forming apparatus according to claim 10, wherein the peripheral device is a facsimile reception and transmission unit.

12. The image forming apparatus according to claim 8, wherein the process cartridge has a photosensitive drum, a developer chamber that contains developer, and a developing roller that supplies developer to the photosensitive drum.

13. The image forming apparatus according to claim 12, wherein the attaching and detaching of the process cartridge is in a direction perpendicular to an axial direction of the photosensitive drum.

14. The image forming apparatus according to claim 12, further comprising a laser scanner unit mounted above the process cartridge.

* * * * *